United States Patent [19]

Cook

[11] Patent Number: 4,902,861

[45] Date of Patent: Feb. 20, 1990

[54] INERTIA SWITCH

[75] Inventor: John E. Cook, Chatham, Canada

[73] Assignee: Siemens-Bendix Automotive Electronics Limited, Chatham, Canada

[21] Appl. No.: 326,825

[22] Filed: Mar. 20, 1989

[51] Int. Cl.[4] ..... H01H 35/14; H01H 35/40

[52] U.S. Cl. ..... 200/61.48; 200/61.51; 200/83 N; 200/83 W

[58] Field of Search ..... 200/61.25, 61.45 R, 200/61.53, 83 N

[56] References Cited

U.S. PATENT DOCUMENTS

| | | | |
|---|---|---|---|
| 665,998 | 1/1901 | Davis | 200/61.51 |
| 2,741,675 | 4/1956 | Chase et al. | 200/61.49 |
| 3,097,272 | 7/1963 | Hautly | 200/61.49 |
| 3,717,861 | 2/1973 | Wright, Jr. | 200/83 N |
| 3,911,393 | 10/1975 | Biggs | 200/83 N |
| 4,581,506 | 4/1986 | Bai et al. | 200/61.48 X |
| 4,581,507 | 4/1986 | Bai et al. | 200/61.48 X |
| 4,608,468 | 8/1986 | Bai | 200/61.48 X |

*Primary Examiner*—J. R. Scott

*Attorney, Agent, or Firm*—George L. Boller; Russel C. Wells

[57] ABSTRACT

An inertia switch for a supplemental inflatable restraint system. The switch comprises a casing that is divided into two chambers by an axially movable diaphragm. The diaphragm carries an electrical contact on one face and an inertial mass on the other. A pair of terminals are disposed in the path of travel of the electrical contact so that when the switch is subjected to axial deceleration force the contact is urged toward the terminals. Actual contact is made when the deceleration force equals or exceeds a predetermined deceleration characteristic. The deceleration characteristic is a function not only of the diaphragm, the electrical contact, and the mass, but also of a control orifice located in an orifice that communicates the two chambers with each other. The chambers are constructed such that air is forced from one chamber into another through the control orifice when deceleration occurs and this imparts a dampening to the motion of the diaphragm.

13 Claims, 1 Drawing Sheet

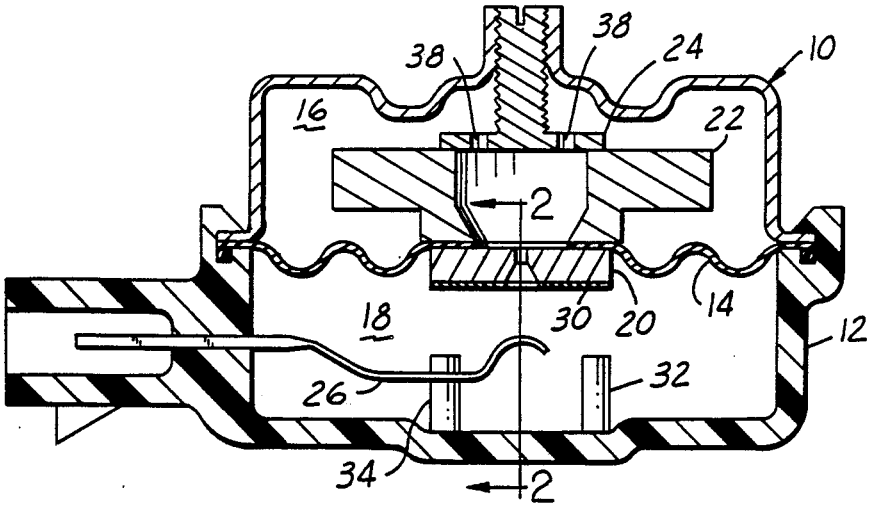
FIG. 1
FIG. 2
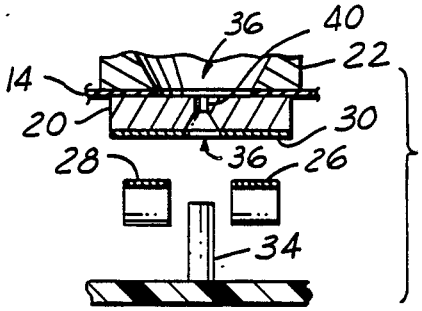

INERTIA SWITCH

BACKGROUND AND SUMMARY OF THE INVENTION

This invention relates to an inertia switch.

Supplemental inflatable restraint devices that are used in automobiles are activated by inertia switches. These switches sense predetermined deceleration characteristics and provide switch closure signals to the devices when such predetermined characteristics are sensed. The predetermined deceleration characteristic that creates switch closure is a function of both the magnitude of deceleration and its duration. The ability of a switch to sense a predetermined deceleration characteristic is determined by the switch design. In order to embody this design in production switches, manufacturing tolerances must be closely controlled.

One known type of inertia switch that is used with supplemental inflatable restraint devices comprises a sphere that travels within a tube. The predetermined deceleration characteristic that will activate the switch is a function of several parameters. One of these parameters is the closeness of the fit of the sphere within the tube. Controlling the accuracy of this fit in production switches is a significant portion of the switch cost.

The present invention relates to an inertia switch which does not utilize the tube and sphere construction and for that reason offers the potential for reducing costs associated with the production of inertia switches for supplemental inflatable restraints while still attaining a specified degree of accuracy in such switches.

Briefly, a switch embodying principles of the invention comprises a casing containing a diaphragm that divides the casing into two chambers. The diaphragm can move axially within the casing. An electrical contact is carried by the face of the diaphragm that bounds one chamber. Terminals are disposed in that chamber in the path of travel of the electrical contact as the diaphragm moves toward that chamber. The face of the diaphragm that is toward the other chamber carries a mass since the electrical contact may be insufficient by itself to provide enough mass for the diaphragm. The diaphragm is constructed such that the electrical contact is biased out of contact with the terminals, and this represents the off condition of the switch. In response to an axial force urging the mass, diaphragm, and electrical contact toward the terminals, the electrical contact will be forced to make contact with the terminals provided that a predetermined deceleration characteristic is exceeded. This represents the closed condition of the switch, whereby the switch provides a signal to an associated supplemental inflatable restraint system.

The predetermined deceleration characteristic that causes switch closure is a function not just of the diaphragm and the mass that it carries, but also of a control orifice. The control orifice is provided in an orifice structure passing through the electrical contact, the diaphragm, and the mass, and serving to communicate each chamber to the other. The casing is constructed and arranged such that air must be forced through the control orifice as the diaphragm, the mass, and the electrical contact move toward the terminals, and accordingly, the control orifice performs a timing function that forms a part of the predetermined deceleration characteristic to which the switch is responsive. Stated another way, the requirement that air be forced through the control orifice imparts a certain dampening to the diaphragm travel. In the disclosed embodiment of the invention the control orifice is in the electrical contact. The orifice can be formed quite accurately in the electrical contact by known methods, and in this way the timing function can be economically incorporated in production switches with the required degree of accuracy.

The foregoing features, advantages, and benefits of the invention, along with others, will be seen in the ensuing description, and claims, which should be considered in conjunction with the accompanying drawings. The drawings disclose a preferred embodiment of the invention according to the best mode contemplated at the present time in carrying out the invention.

BRIEF DESCRIPTION OF THE DRAWINGS

FIG. 1 is an axial cross sectional view through an inertia switch embodying principles of the invention.

FIG. 2 is a fragmentary sectional view taken along line 2—2 in FIG. 1.

DESCRIPTION OF THE PREFERRED EMBODIMENT

The drawings show an inertia switch 10 that comprises a casing 12 containing a diaphragm 14 that divides the casing into two chambers 16, 18. The face of diaphragm 14 that is toward chamber 18 carries an electrical contact 20 which is centrally disposed on that face of the diaphragm. The opposite face of the diaphragm carries a mass 22.

The drawings show the switch in the off condition. Diaphragm 14 is constructed of a metal, such as stainless steel, and designed to bias the diaphragm toward chamber 16 where mass 22 is in abutment with a stop 24. When the switch is subjected to an axial deceleration tending to urge diaphragm 14 toward chamber 18, electrical contact 20 will be displaced axially by the diaphragm and into bridging contact with a pair of electrical terminals 26, 28 having interior ends disposed within chamber 18. These two terminals pass through the casing wall where they are available for connection with electrical circuitry of a supplemental inflatable restraint system to supply, when bridged by contact 20, a signal indicative of switch closure representing the inertia switch having experienced a deceleration force whose magnitude and duration equal or exceed the predetermined characteristic to which the switch is responsive. Contact 20 is an electrically conductive metal, and preferably includes a thin coating 30 of a material such as gold across the face that makes contact with terminals 26, 28. A pair of posts 32, 34 project axially from the inside of the end wall of casing 12 to form stops that abut contact 20 to arrest the displacement of the diaphragm after terminals 26, 28 have been bridged by contact 20.

The two chambers 16, 18 are communicated by orifice means 36. The orifice means passes from chamber 18 centrally through electrical contact 20, through diaphragm 14 and through mass 22. To assure communication with chamber 16 where mass 22 is abutted by stop 24, holes 38 are provided in stop 24 as shown. The orifice means 36 includes a control orifice 40 formed in electrical contact 20. The two chambers are constructed and arranged such that when the switch is subjected to axial deceleration force that displaces the diaphragm, mass, and contact toward the terminals, a pressure differential is created between the two chambers causing air to be forced through the orifice means, including the control orifice. Accordingly, the control orifice creates a means for controlling the timing of the switch closure, in other words the amount of dampening the diaphragm motion. Hence, the predetermined deceleration characteristic that will be effective to operate the switch to the closed condition is a function not only of the diaphragm, the mass, and the electrical contact but also of the control orifice.

It should be understood that the drawing figures are not necessarily representative of actual proportions. The control orifice will be quite small but can be formed into the electrical contact by conventional procedures that are used to create small, but very accurate holes. These procedures can be economically conducted. The switch parts can be fabricated by conventional manufacturing processes, and the switch itself is not especially complicated. Therefore, a worthwhile improvement on manufacturing costs can be obtained without sacrificing performance characteristics of an inertia switch. Where necessary, the stop 24 can be made axially adjustable as shown, to provide a certain degree of calibration. It is also contemplated that the diaphragm can be constructed with an over-center effect, such as occurs in a conical washer, to impart the desired bias. As is well known in the design of inertia switches, switch closure depends both upon the magnitude of force applied to the switch and also the duration of force application, and that will be true for the switch of the present invention.

While a presently preferred embodiment of the invention has been disclosed, it will be appreciated that principles are applicable to other embodiments.

What is claimed is:

1. An inertia switch comprising:

a casing that is divided into two chambers by an axially movable diaphragm;

an electrical contact carried by said diaphragm on a face thereof that bounds one of said chambers, said electrical contact being disposed centrally on said face;

a pair of spaced apart terminals disposed in said one chamber in the path of said electrical contact as said diaphragm moves toward said one chamber, a circuit being completed between said pair of terminals when said pair of terminals is contacted by said electrical contact;

orifice means passing through said electrical contact and said diaphragm to communicate said two chambers with each other, said orifice means comprising a control orifice, said control orifice being in said electrical contact;

said inertia switch occupying an off state, when subjected to axial force below a predetermined magnitude and duration characteristic in a sense urging said electrical contact and said diaphragm toward said pair of terminals, said off state being defined by said electrical contact being spaced from said pair of terminals; and said inertia switch assuming an on state, when subjected to axial force in said sense equaling or exceeding said predetermined magnitude and duration characteristic, said on state being defined by said electrical contact being placed in contact with said pair of terminals;

said orifice means functioning to conduct a gas from said one chamber to the other of said chambers in response to displacement of said electrical contact and said diaphragm toward said pair of terminals, said control orifice restricting the flow of gas through said orifice means to impart dampening to the motion of said diaphragm and said electrical contact toward said pair of terminals.

2. An inertia switch as set forth in claim 1 in which said diaphragm is constructed so as to be inherently biased in the axial direction away from said pair of terminals.

3. An inertia switch as set forth in claim 2 in which said diaphragm includes a mass that is carried centrally by said diaphragm on the face thereof that is toward said other chamber, said orifice means also passing through said mass.

4. An inertia switch comprising:

a casing that is divided into two chambers by an axially movable diaphragm;

an electrical contact carried by said diaphragm on a face thereof that bounds one of said chambers, said electrical contact being disposed centrally on said face;

a pair of spaced apart terminals disposed in said one chamber in the path of said electrical contact as said diaphragm moves toward said one chamber, a circuit being completed between said pair of terminals when said pair of terminals is contacted by said electrical contact;

orifice means passing through said electrical contact and said diaphragm to communicate said two chambers with each other, said orifice means comprising a control orifice;

said inertia switch occupying an off state, when subjected to axial force below a predetermined magnitude and duration characteristic in a sense urging said electrical contact and said diaphragm toward said pair of terminals, said off state being defined by said electrical contact being spaced from said pair of terminals; and said inertia switch assuming an on state, when subjected to axial force in said sense equaling or exceeding said predetermined magnitude and duration characteristic, said on state being defined by said electrical contact being placed in contact with said pair of terminals;

in which said diaphragm is constructed and arranged so as to be inherently biased in the axial direction away from said pair of terminals;

in which said diaphragm includes a mass that is carried central by said diaphragm on the face thereof that is toward the other of said chambers, said orifice means also passing through said mass; and including a stop for engaging said mass to set a limit for the extent to which said diaphragm is biased away from said pair of terminals.

5. An inertia switch as set forth in claim 4 in which said stop is adjustable on said casing.

6. In an inertia switch, the combination of a casing having a diaphragm portion dividing the casing into two chambers, orifice means passing through said diaphragm portion for communicating said two chambers with each other, said two chambers being constructed and arranged such that in response to an axial force of predetermined magnitude and duration applied to said switch, said diaphragm portion is urged axially toward a terminal means in one of said chambers so that an electrical contact portion of said diaphragm portion can make contact therewith and thereby cause the switch to give a switch signal via said terminal means, said orifice means comprising a control orifice through which air is forced from said one chamber to the other to impart dampening to the motion of said diaphragm portion as said diaphragm portion and electrical contact portion are displaced toward said terminal means.

7. The combination set forth in claim 6 wherein said control orifice is in said electrical contact portion.

8. Inertia switch structure comprising:

a casing;

a diaphragm that divides said casing into two chambers and is axially displaceable within said casing;

orifice means in said structure through which a gas in one of said two chambers can be driven from said one chamber;

electrical terminal means disposed in said one chamber in the path of axial displacement of said diaphragm;

said two chambers, said diaphragm, and said terminal means being constructed and arranged such that in response to an axial force of predetermined magnitude and duration applied to said inertia switch structure, said diaphragm is displaced axially within said casing toward said one chamber to cause a switch signal representative of the occurrence of said axial force to be given at said terminal means; and said orifice means comprising control orifice means through which gas is driven from said one chamber as said diaphragm is being displace toward said one chamber, said control orifice means serving to impart dampening to the motion of said diaphragm toward said terminal means.

9. An inertia switch structure as set forth in claim 8 in which said diaphragm is constructed so as to be inherently biased in the axial direction away from said terminal means.

10. An inertia switch structure as set forth in claim 9 in which said diaphragm includes a mass that is carried centrally by said diaphragm on the face thereof that is toward said other chamber, said orifice means also passing through said mass.

11. An inertia switch structure as set forth in claim 10 including a stop for engaging said mass to set a limit for the extent to which said diaphragm is biased away from said terminal means.

12. An inertia switch structure as set forth in claim 9 including means acting between said casing and said diaphragm to form a stop that limits the extent to which said diaphragm is biased away from said terminal means.

13. An inertia switch structure as set forth in claim 8 in which said orifice means is arranged to communicate said one chamber to said other chamber so that gas from said one chamber is forced through said orifice means into said other chamber as said diaphragm is axially displaced toward said terminal means.

* * * * *